US005668341A

United States Patent [19]

Reynolds et al.

[11] Patent Number: 5,668,341

[45] Date of Patent: Sep. 16, 1997

[54] SILENT MORTAR PROPULSION SYSTEM

[76] Inventors: George L. Reynolds, Rte. 1 Box 32A, Altona, Ill. 61414; John M. Miller, Rte. 3 Winters Dr., Marietta, Ohio 45750; Charles M. Woods, 11395 State Rte. 127, West Manchester, Ohio 45382

[21] Appl. No.: 489,672

[22] Filed: Jun. 12, 1995

[51] Int. Cl.[6] ..... F41F 1/06

[52] U.S. Cl. ..... 89/1.35; 102/434

[58] Field of Search ..... 89/1.35, 1.816, 89/40.02, 37.05; 102/445, 489, 375, 433, 434

[56] References Cited

U.S. PATENT DOCUMENTS

| | | | |
|---|---|---|---|
| 1,480,957 | 1/1924 | Schneider | 102/434 |
| 1,757,675 | 5/1930 | Methlin | 102/445 |
| 2,359,515 | 10/1944 | Fanger | 102/434 |
| 3,134,330 | 5/1964 | Batou | 89/1.35 |
| 3,505,924 | 4/1970 | Driscoll | 89/1.35 |
| 4,012,987 | 3/1977 | Burkhalter et al. | 89/1.816 |
| 4,173,186 | 11/1979 | Dunham | 102/434 |
| 4,197,801 | 4/1980 | LaFever et al. | 102/434 |
| 4,335,657 | 6/1982 | Bains | 102/433 |

*Primary Examiner*—Michael J. Carone
*Assistant Examiner*—Christopher K. Montgomery
*Attorney, Agent, or Firm*—Robert O. Richardson

[57] ABSTRACT

A propulsion system to provide silent firing of a mortar weapon using standard and nonstandard mortar tubes or launch assemblies has been invented. The system utilizes a precision rupture disc mechanism to control combustion and energy release to effect consistent operation. The gases generatedd by combustion of the propellant charge are contained by the rupture disc which insures uniform and efficient propellant combustion. After rupture of the disc at a prescribed pressure, the projectile is accelerated by the expanding gases through the action of a piston on the warhead. The gases are retained within the projectile after accelerating the projectile, preventing release of high pressure gas and resulting in a silent launch condition.

In a first embodiment the warhead and piston moves first and then the heavier cylinder is moved. In a second embodiment the cylinder moves with the warhead and picks up the lighter piston. This takes less force than the first embodiment, permitting a lighter charge to achieve the same flight range for the warhead.

Another improvement permits the same amount of explosive for charge 0 and charge 1 ranges. This is done by varying the size of the free volume between the piston head and the top of the cylinder which drives the warhead in flight.

4 Claims, 3 Drawing Sheets

SILENT MORTAR PROPULSION SYSTEM

BACKGROUND OF INVENTION

Mortars are short range, muzzle loading, drop fired guns which fire various exploding and chemical warheads. Mortars are sometimes used in clandestine and other operations in which the noise of firing, and the heavy weight of the steel launch tube restrict the use of the weapon. The noise of firing at short ranges reveals the position of the firing site, inviting counterattack. While mortars are typically light weight for their bore size, the weight of the launch tube limits those operations in which the weapons have to be manually carried into action.

The need for silent, lightweight mortars for clandestine, and other military missions has long existed. Those mortar systems that do exist are specialized and not widely applicable to a broad range of military operations. There are no systems that exist where silent ammunition can be fired from standard weapons.

SUMMARY OF PRESENT INVENTION

The present invention is applied to muzzle loading mortars in which the propellant combustion process and launching means are entirely self contained such that no gasses are released into the launcher or into the atmosphere during firing. This is done through the use of a moveable piston within a cylinder. The piston extends relative to the cylinder through the action of expanding propellant gasses. The propellant energy produced is released by a precision rupture disc mechanism in such a way as to maximize coupling with the projectile mass through the action of the piston. The cylinder is accelerated by a crush-up media designed to absorb excess energy without failure at the end of the piston stroke. The propulsion gasses are contained in the chamber formed by the cylinder and piston, and the piston and cylinder are both carried with the warhead. This means there is no muzzle blast or other escaping gas which can be heard in a short range target area. The propellant gas containment system also permits firing the round from a lightweight tube supported securely by the ground or other large mass. This tube may also play a dual role, such as an ammunition packaging container. The launch system also provides for the option to be fired from a simple flat based open launcher. A conventional gun tube, per se, need not be carried on the mission if only this invention propulsion system is to be employed. This will allow for faster entry and retreat, creating options for use in places where the weight of the present gun tube would prevent accessibility. On the other hand, if a conventional mortar weapon is carried, then the silent ammunition can be fired interchangeably with conventional ammunition.

In addition to the foregoing, there are additional improvements. Instead of varying the amount of explosive between charge 0 and charge 1, the explosive area within the propulsion unit is readily adjusted to vary the range as desired between charge 0 (50 to 400 yards ) and charge 1 (approximately ½ mile), making the same explosive unit available for use in firing either charge. Another improvement is in firing the larger cylinder mass with the smaller piston mass trailing. Still another improvement is to use the plastic ammunition container as the mortar firing tube while preventing its accidential use by attempting to fire a conventional mortar round by mistake.

BRIEF DESCRIPTION OF THE DRAWINGS

FIG. 1 shows the mortar round 10 as it is falling down the mortar tube 12 after having been manually loaded into the muzzle 14 of the mortar tube 12 and released, FIG. 2 shows the mortar propellant 16 having been ignited by stab-initiation of the primer 18, FIG. 3 shows the acceleration phase of the mortar warhead 20. The propellant pressure has ruptured the rupture disc 22 and the propellant gas pressure is accelerating the piston 24 with the warhead 20, FIG. 4 shows the crush-up phase of operation in which the rear cylinder portion 26 of the mortar warhead 20 is being rapidly accelerated to the velocity of the piston 24 and warhead 20, FIG. 5 shows the entire warhead 20 at full launch velocity.

DETAILED DESCRIPTION OF ILLUSTRATIVE EMBODIMENT

Figure 1:
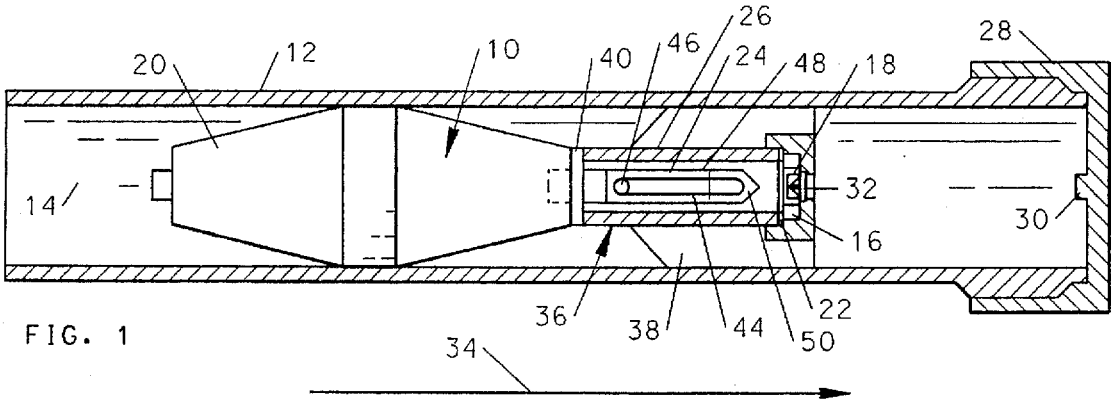
FIGS. 1 through 5 are elevational side views in section in which parts have been broken away to show the operating elements as they function during firing.

Reference is made to FIG. 1 wherein is shown a conventional mortar gun tube 12 supported by a mortar tube base 28 at its lower end. Firing pin 30 is centrally positioned on the tube base 28 to actuate the mortar round 10 when hit by striker 32 on the lower end of the mortar round 10 as the mortar round 10 falls downwardly in the direction shown by direction arrow 34. It is normal mortar practice to drop-fire the round in which the kinetic energy of the dropped round is used to stab-initiate the primer 18.

Mortar round 10 consists of a warhead 20 which explodes at the target area, and a propulsion unit 36 having guide fins 38 and power cylinder 26. This propulsion unit 36 is connected through piston 24 to the base of warhead 20 through an adapter 40 connected to both. Mounted on the lower end of the power cylinder 26 is a cylinder cap 42 in which is placed a propellant charge 16, primer 18 and striker 32. A thin rupture disc 22 separates the propellant charge 16 from a piston 24 that moves upwardly within power cylinder 26 upon firing. Piston 24 moves within cylinder 26 and is connected to the adapter 40.

Piston 24 has a vertical slot 44 and cylinder 26 has a pickup pin 46 extending through slot 44. This permits relative movement from their positions shown in FIG. 2 and in FIG. 5. This pin and slot connection permits warhead 20 to move upwardly earlier than power cylinder 26 upon firing, leaving a short dwell time before the bottom of the slot 44 engages pin 46 and causing the power cylinder 26 to follow the warhead 20 to its target. As a result the propulsion noise and flash is contained within the power cylinder 26.

In addition to the slot 44 in piston 24 there is a vertical bore 48 extending down past the lower end of slot 44 but not through the lower end of piston 24. A cushioning substance 50 such as crushable aluminum or other metallic sponge is positioned in the lower end of bore 48 below pin 46. This cushions the impact of pin 46 at the lower end of slot 44 and causes power cylinder 26 to follow warhead 20 in its flight to its target.

Figure 2:
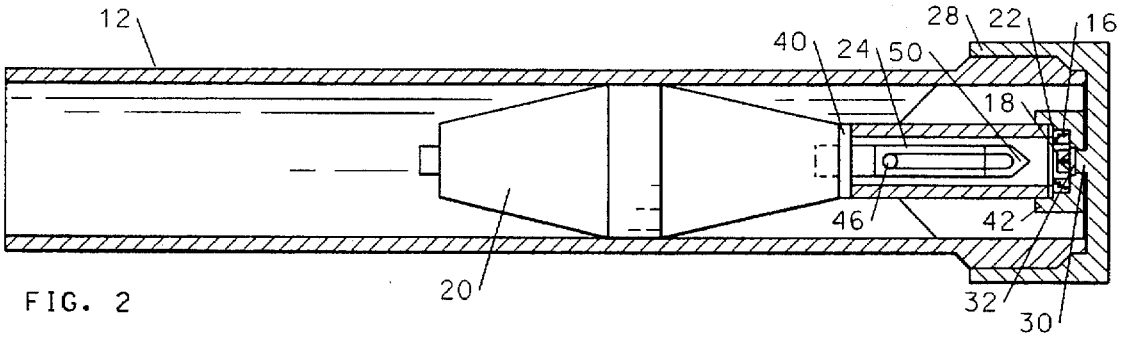

Referring now to FIG. 2 the firing pin 46 in the mortar tube base 28 has impacted the striker 32 initiating the primer 18. The primer 18 ignites the propellant charge 16 generating a quantity of hot pressuring gasses. The combustion process takes place in the cylinder cap 42 until enough internal pressure builds to exceed the burst strength of the rupture disc 22. The rupture disc 22 fails at a precisely designed pressure to provide adequate and consistent acceleration of the mass of the piston 24, adapter 40, warhead 20, and cushioning substance 50. The purpose of the rupture is two-fold. It provides controlled combustion of the propellant by containment of the reaction gasses. It also provides for controlled release of these gasses at a prescribed pressure that optimizes conversion of the chemical energy released from the propellant burn and consistent acceleration of the warhead 20 from round to round.

Figure 3:
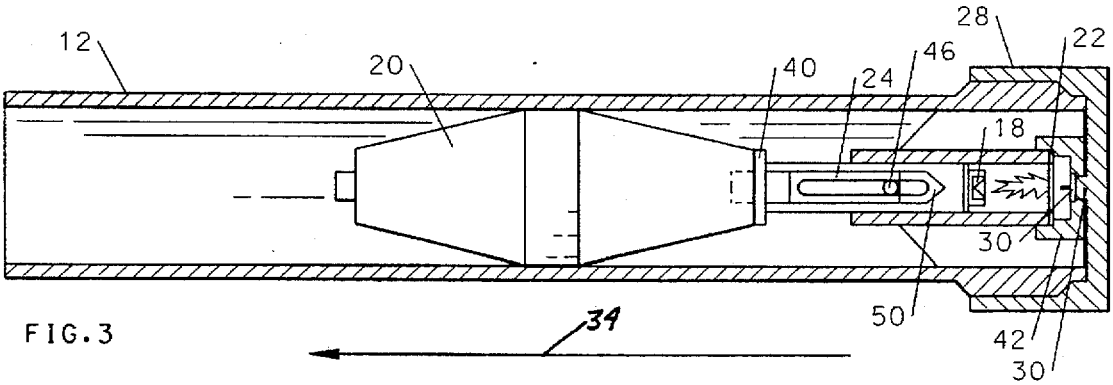

Referring now to FIG. 3 the expanding pressurized gas has exceeded the strength of the rupture disc 22, and has overcome the inertia of the warhead 20 and the other accelerating parts. The cushioning substance or crush-up media 50, which has been moving with the piston 24, has just contacted the pick up pin 46. Warhead 20 is moving upwardly in the direction of arrow 34.

Figure 4:
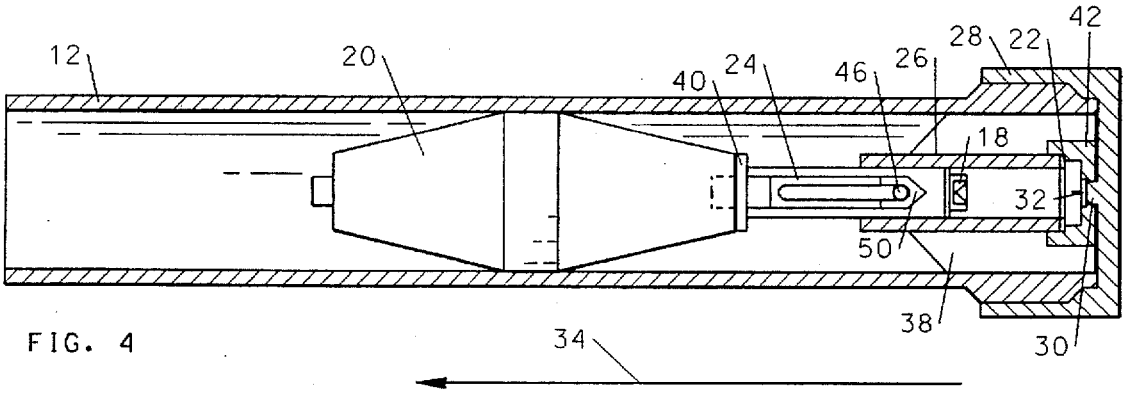

Referring now to FIG. 4 the cushioning substance 50 is plastically deformed by being forced past the pick up pin 46. The purpose of substance 50 is to prevent a sharp impact of the pick up pin 46 with the cylinder 26 minimizing the stress in the pin and other structural members. The energy required to deform this substance 50 is somewhat greater than the energy required to accelerate the stationary cylinder 26 with its fins 38, the cylinder cap 42, striker 32, and stationary portion of the rupture disc 22 remaining with the stationary parts because of residual pressure in the system. This residual pressure also aids in locking the assembly in place when proper alignment is attained.

Figure 5:
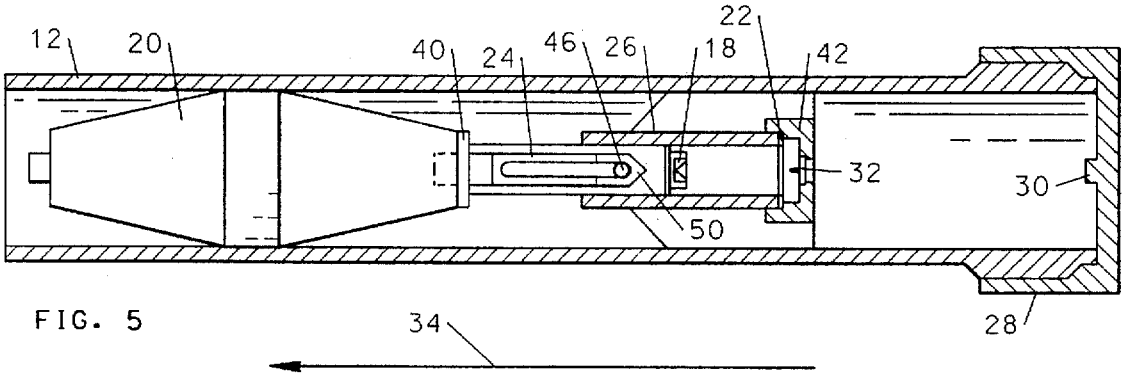

Referring now to FIG. 5 the cushioning substance of crush-up material 50, in being deformed, has accelerated the cylinder 26, cylinder cap 42, striker 32 and portion of the rupture disc 22 remaining with the cylinder 26. The complete assembly is now moving with the velocity resulting from the conservation of momentum of all the mass involved.

In this entire process the gasses generated by combustion of the propellant charge have been contained inside the chamber formed by the piston 24, cylinder 26 and cylinder cap 42. This prevents noise that would be generated by high pressure gas escaping to the atmosphere.

Figure 6:
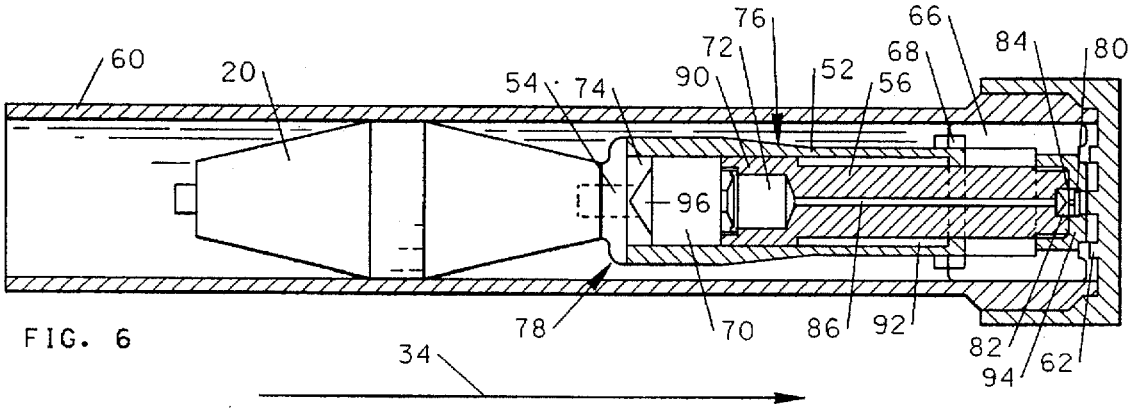
FIG. 6 is a sectional view of an improved version with a charge 0.
Figure 7:
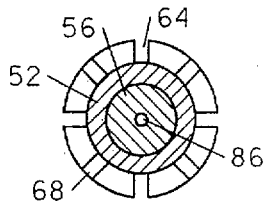
FIG. 7 is a sectional view showing how charge 0 is achieved.
Figure 9:
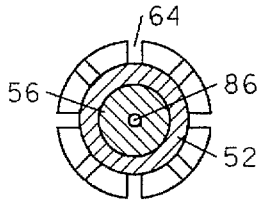
FIG. 9 is a sectional view showing how a charge 1 is achieved.
Figure 10:
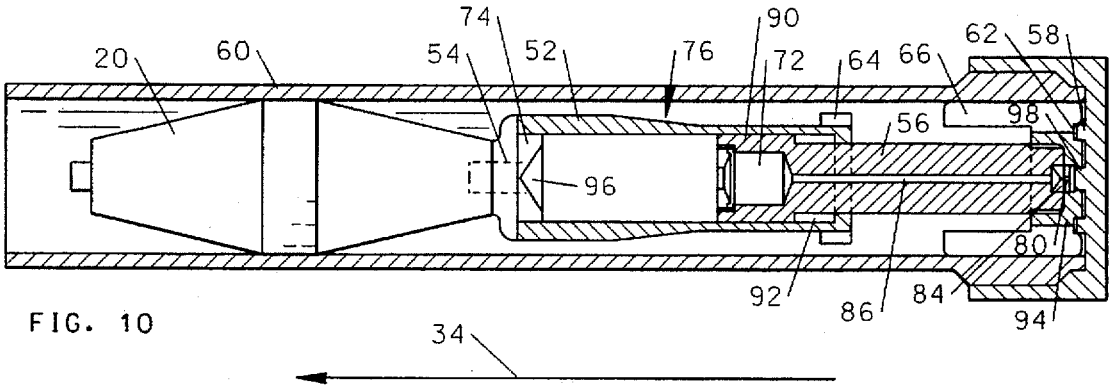
FIG. 10 is a sectiional view showing the improved version fired from a plastic ammunition container that will not fire a conventional mortar round.
Figure 8:
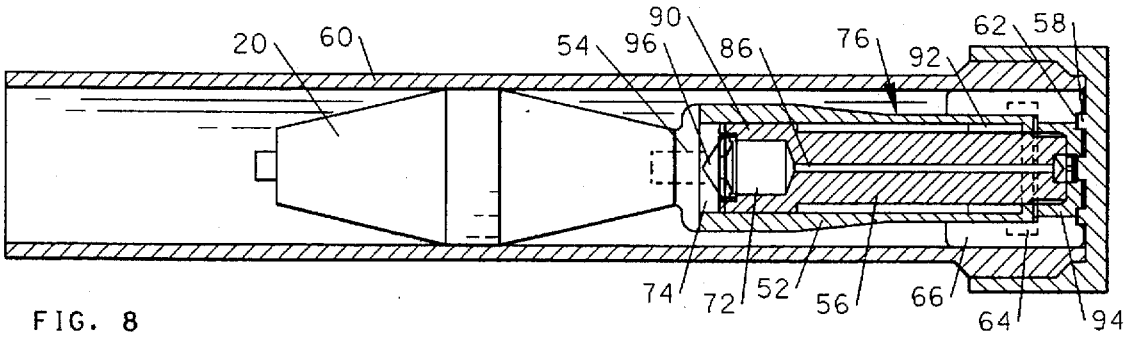
FIG. 8 is a sectional view of the improved version with a charge 1.

An improved version is shown in FIGS. 6–10. In this embodiment the power cylinder 52 is connected to the warhead, not shown, by adapter 54 and the piston 56 trails the cylinder 52 when the mortar is fired. With the lesser weight of the piston trailing, less explosive is needed in firing the mortar and still reach its target. FIGS. 6, 8 and 10 illustrate this feature. Another improvement is in adjusting a relatively large free volume with a charge 0 (50–400 yard range) to a small free volume for a ½ mile range instead of normally requiring a differant charge 1 explosive powder. The reverse is also true. With a charge 1 explosive and changing a relatively small free volume, the mortar can be fired in the charge 0 range of 50–400 yards. By combining charge 0 and charge 1 ranges, the variety of explosive charges are reduced. FIGS. 6–9 illustrate how these charges are reduced and how these changes may be made.

Another improvement in the version shown in FIGS. 6–10 is the ability to fire this mortar from a plastic ammunition container used in transporting mortar rounds instead of using a conventional mortar gun tube for firing the mortar rounds. Without using a mortar gun tube in firing a mortar round, the advantages are many and obvious. However, without the improvements in the mortar round and plastic ammunition carrier, the accidental firing of a conventional mortar would blow up the mortar container "gun tube" and kill the mortar operators. This will not happen with the improvement shown in FIG. 10. A raised safety ring 58 in the bottom of the plastic ammunition container 60 mating with a grooved safety ring 62 on the bottom of piston 56, permits the mortar round to drop fully into the plastic container 60 and permit detonation. A conventional mortar round does not have a grooved safety ring to receive the container raised ring and thus the container raised ring prevents further downward movement of the conventional mortar and it will not detonate.

Reference is now made to FIGS. 6 and 7. Cylinder 52 is connected at its upper end by adapter 54 to the warhead 20. At the lower end of cylinder 52 are radially extending grooves 64 to receive a part of fins 66 which are attached to piston 56. The lower end of cylinder 52 also has radially extending notches 68 which permit only limited upward movement, creating a large free volume area 70 between the top of piston 56 and the top of cylinder 52, as shown in FIG. 6. With this large free volume 70, the powder in powder chamber 72, when ignited, will exert a lesser force on the top 74 of power cylinder 52 to provide for a shorter range for the warhead projection.

The firing of the propulsion unit 76 in FIG. 6 requires dropping the mortar round 78 and propulsion unit 76 down a mortar tube, or plastic ammo container 60 as explained with reference to FIG. 10, where striker 80 hits the firing pin, not shown, and ignites propellant charge 82 after breaking rupture disc 84. This propellant charge expands through hole 86 in the middle of piston 56 to power chamber 72 where it ignites the explosive powder (not shown) breaking top rupture disc 88, permitting the expansion gases to pressurize the large free volume area 70, driving cylinder 52, and warhead 20, upwardly along its projection path to the target, not shown. When the power cylinder 52 moves upwardly, as shown in its fired position in FIG. 10, the piston head 90 bears down on a crush up medium 92 and then carries whatever is attached to it, such as piston cap 94 and fins 66 along its flight to its target. As shown in FIG. 10, this includes all mortar components which go with it. Hence, all noise and light is contained within cylinder 52 and nothing gives the target occupants information as to where the mortar was fired.

Assume a longer firing range than charge 0, 50–400 yards, in FIG. 6 was desired. The setting of charge 1, ½ mile, is shown in FIGS. 8 and 9. By moving fins 66 down out of notches 68 as in FIG. 6, rotating the fins and moving them upward into grooves 64, the piston 56 can be moved further up into cylinder 52 to reduce the size of the free volume to the small free volume 96 as shown in FIG. 8. As can be seen this reduces the total length of the propulsion unit 74. Suitable indicia may be used, if desired, to relate the length of the propulsion unit to the charge number and hence the range that the warhead will travel, assuming the angle of the mortar base, not shown, has been properly set.

Reference is now made to FIG. 10 which shows the relative positions of piston 56 and power cylinder 52 after the propulsion unit 76 has been fired. The power cylinder 52 has been driven upwardly until the piston head 90 bears against the crush up medium 92. Thereafter, continued upward movement of cylinder 52 carries piston 56 with it to the target, not shown.

FIG. 10 also shows a safety feature that will permit the mortar round 78 to be fired from a plastic ammo container 60 instead of the conventional heavier mortar tube now in use. The container 60 will not permit a conventional mortar round to be fired but will permit the firing of the silent mortars of this invention wherein the propulsion explosives are self-contained within the propulsion unit. This is done with a raised safety ring 58 on the bottom of the container 60 which prevents the striker of a conventional mortar from contacting the firing pin 98. In order for the silent mortar propulsion system of the present invention to fire, striker 80 must pierce rupture disc 84 and ignite propellant charge 82. This is accomplished by providing a grooved safety ring 62 in the bottom of the propulsion unit 74. As shown, this grooved safety ring 62 is formed in piston cap 94 and fins 66 at the lower end of piston 56. This permits the grooved ring 62 to fit over the raised safety ring 58, permitting the silent mortar to fire from the plastic ammo container 60 whereas a conventional mortar cannot.

Having thus described an illustrative embodiment of the invention, it is to be understood that variations will occur to one skilled in the art and that such variations and deviations are to be considered as part of this invention as set forth in the following claims.

What we claim is:

1. A silent mortar propulsion system comprising in combination a mortar gun tube having a firing pin for contacting a mortar round dropped thereon, a silent mortar round comprising a warhead and a propulsion unit connected thereto and adapted to be dropped onto said firing pin to detonate said propulsion unit, said propulsion unit, upon detonation, driving said warhead from said gun tube, said propulsion unit after a short dwell time following said warhead in its flight, said propulsion unit having a power cylinder with a cylinder cap at the lower end thereof, said cylinder cap containing a striker and propellant charge with a rupture disc thereon, a piston within said power cylinder having its upper end attached to said warhead, guide fins extending outwardly from said power cylinder, and wherein said fins may be rotated to fit within grooves and notches on said cylinder to regulate the size of the volume within said cylinder and thus the range of mortar projection.

2. A silent mortar propulsion system as set forth in claim 1 wherein, said piston having a slot therein, a power cylinder having said piston vertically moveable therein, said cylinder having a pin therein passing through said slot in said piston to permit relative movement without detachment therebetween.

3. A silent mortar propulsion system as set forth in claim 1 wherein a slot in said piston terminates at its lower end with a cushioning substance therein to reduce and limit separation between said warhead and said power cylinder.

4. A silent mortar propulsion system comprising a gun tube with an upwardly directed opening for receiving a mortar round therein, said mortar round including a warhead connected to a propulsion unit having a cylinder with a closed upper end and having a piston with an upper end moveable therein, means rapidly exerting pressure between said cylinder upper end and said piston to expand rapidly the space therebetween, and means retaining said upper end of said piston within said cylinder, said warhead being connected by an adaptor to said cylinder upper end, said piston having a propellant charge at the lower end thereof and a bore therefrom extending to the upper end thereof, said means exerting pressure being contained in said piston upper end until said propellant charge is detonated.

* * * * *